US009119467B2

(12) United States Patent
Elizondo, Jr. et al.

(10) Patent No.: US 9,119,467 B2
(45) Date of Patent: Sep. 1, 2015

(54) IRONING BOARD STORAGE DEVICE ASSEMBLY AND METHOD

(71) Applicant: Household Essentials, LLC, Hazelwood, MO (US)

(72) Inventors: Baldemar Elizondo, Jr., Broken Arrow, OK (US); James L. Glenn, St. Albans, MO (US)

(73) Assignee: HOUSEHOLD ESSENTIALS, LLC, Hazelwood, MO (US)

( * ) Notice: Subject to any disclaimer, the term of this patent is extended or adjusted under 35 U.S.C. 154(b) by 0 days.

(21) Appl. No.: 14/157,965

(22) Filed: Jan. 17, 2014

(65) Prior Publication Data

US 2014/0246963 A1 Sep. 4, 2014

Related U.S. Application Data

(60) Provisional application No. 61/772,344, filed on Mar. 4, 2013.

(51) Int. Cl.

| | |
|---|---|
| ***A47B 77/10*** | (2006.01) |
| ***D06F 81/06*** | (2006.01) |
| *D06F 81/02* | (2006.01) |
| *A47B 5/04* | (2006.01) |
| *A47B 46/00* | (2006.01) |

(52) U.S. Cl.

CPC ..... *A47B 77/10* (2013.01); *D06F 81/06* (2013.01); *A47B 5/04* (2013.01); *A47B 46/005* (2013.01)

(58) Field of Classification Search

CPC ..... A47B 77/00; A47B 77/10; A47B 5/04; A47B 13/02; D06F 81/00; D06F 81/02; D06F 81/04; D06F 81/06

USPC ..... 38/103, 104, 137–139; 108/38, 39, 40, 108/48; 312/237, 242

See application file for complete search history.

(56) References Cited

U.S. PATENT DOCUMENTS

| | | | | | |
|---|---|---|---|---|---|
| 960,213 | A | | 5/1910 | Williams | |
| 1,207,268 | A | | 12/1916 | Blanchard | |
| 1,532,312 | A | * | 4/1925 | Hurd | 108/39 |
| 1,560,962 | A | | 11/1925 | Agee | |
| 1,568,376 | A | * | 1/1926 | Grant | 108/39 |
| 1,581,428 | A | | 4/1926 | Cummings | |
| 1,790,468 | A | * | 1/1931 | Frank et al. | 108/38 |
| 1,796,569 | A | | 3/1931 | Madsen | |
| 1,849,184 | A | | 3/1932 | Gay | |
| 1,920,452 | A | | 8/1933 | Wagner | |
| 1,940,128 | A | * | 12/1933 | Howard | 108/39 |
| 2,003,604 | A | | 6/1935 | McLeod | |
| 2,358,906 | A | | 9/1944 | Bullard | |
| 2,483,899 | A | | 10/1949 | Grasso et al. | |
| 2,517,256 | A | | 8/1950 | Summers | |
| 2,535,755 | A | * | 12/1950 | Rieter | 108/39 |
| 2,646,634 | A | | 7/1953 | Mongar | |
| 2,680,314 | A | | 6/1954 | Snyder | |
| 2,963,804 | A | * | 12/1960 | Frechette | 108/39 |

(Continued)

*Primary Examiner* — Ismael Izaguirre

(74) *Attorney, Agent, or Firm* — Polster Lieder Woodruff & Lucchesi L.C.

(57) ABSTRACT

The present invention is an ironing board storage device that removeably attaches to a wall and rests on a support surface. The device includes an ironing board moveably mounted to a frame assembly within a housing for vertical movement between different elevations and pivotal movement of the ironing board between a generally vertical storage position with a distal end positioned beneath the proximal end to and generally horizontal operating position.

12 Claims, 12 Drawing Sheets

(56) References Cited

U.S. PATENT DOCUMENTS

| | | | | | |
|---|---|---|---|---|---|
| 3,161,159 | A | | 12/1964 | Kritske | |
| 3,185,278 | A | | 5/1965 | Miller et al. | |
| 3,663,080 | A | | 5/1972 | Ayers | |
| 3,696,762 | A | | 10/1972 | Holdham | |
| 3,730,107 | A | * | 5/1973 | Bergkamp et al. | 108/39 |
| 3,742,868 | A | * | 7/1973 | Garceau et al. | 108/39 |
| 4,422,556 | A | | 12/1983 | Moore | |
| 4,666,117 | A | | 5/1987 | Taft | |
| 4,862,811 | A | | 9/1989 | Davis | |
| 4,909,158 | A | * | 3/1990 | Sorensen | 108/40 |
| 4,995,681 | A | | 2/1991 | Parnell | |
| 5,570,642 | A | | 11/1996 | Lehrman | |
| 5,810,304 | A | | 9/1998 | Lehrman | |
| 5,924,226 | A | | 7/1999 | Zuber | |
| 5,950,337 | A | | 9/1999 | Lehrman | |
| 6,412,423 | B1 | | 7/2002 | Elizondo, Jr. | |
| 6,612,529 | B2 | | 9/2003 | Snyder | |
| 6,684,540 | B1 | | 2/2004 | Tufts | |
| 7,131,222 | B1 | | 11/2006 | Glenn | |
| 7,278,229 | B1 | * | 10/2007 | Fen | 38/137 |
| 7,395,620 | B1 | * | 7/2008 | McNeely et al. | 38/137 |
| 7,575,213 | B2 | | 8/2009 | Rausch | |
| 8,272,153 | B2 | | 9/2012 | Elizondo, Jr. | |
| 2010/0117502 | A1 | | 5/2010 | Kang et al. | |
| 2013/0154459 | A1 | * | 6/2013 | Murphy et al. | 312/237 |

* cited by examiner

IRONING BOARD STORAGE DEVICE ASSEMBLY AND METHOD

CROSS-REFERENCE TO RELATED APPLICATIONS

This application claims priority to application No. 61/772,344 filed Mar. 4, 2013, which is incorporated herein by reference.

STATEMENT REGARDING FEDERALLY SPONSORED RESEARCH

Not Applicable.

BACKGROUND OF THE INVENTION

This invention relates to ironing boards for use with an iron-to-iron clothes, and more specifically to storage devices for storing ironing boards. Ironing board storage devices have taken a variety of constructions, but typically have been comprised of a retractable ironing board movably mounted within a cabinet that is concealed in an interior cavity of a wall. The cabinet is installed at an appropriate height so that the ironing board can be rotated downwardly to a generally horizontal operating position relative to the floor. When not in use, the ironing board can be rotated upwardly to a generally vertical position within the cabinet for storage and a door closed to conceal the ironing board.

These types of ironing board storage devices are difficult to install and require major repair work if removed. To install, one must make large openings in an existing wall and properly support the storage device from support studs or the like, which calls for the use of many tools and a great deal of manual labor. For this reason, once the devices are installed they are rarely removed, making the installation effectively permanent. In addition, the location of the storage device is limited by the location of the support studs in the wall. Furthermore, these types of ironing board storage devices do not contain adequate support for the ironing board when placed in the operating position. As a result, the ironing board is not particularly stable and is susceptible to movement during operation. In addition, currently known ironing board storage devices are not adequately accessible by the disabled, in particular those in wheelchairs.

Therefore, there has been a need for an ironing board storage device that is easy to install, easy to operate, economical, easily relocated, accessible to the disabled, and is adequately stable during operation.

DESCRIPTION OF THE DRAWINGS

In the accompanying drawings which form part of the specification.

Corresponding reference numerals indicate corresponding parts throughout the several figures of the drawings.

DETAILED DESCRIPTION

Figure 1:
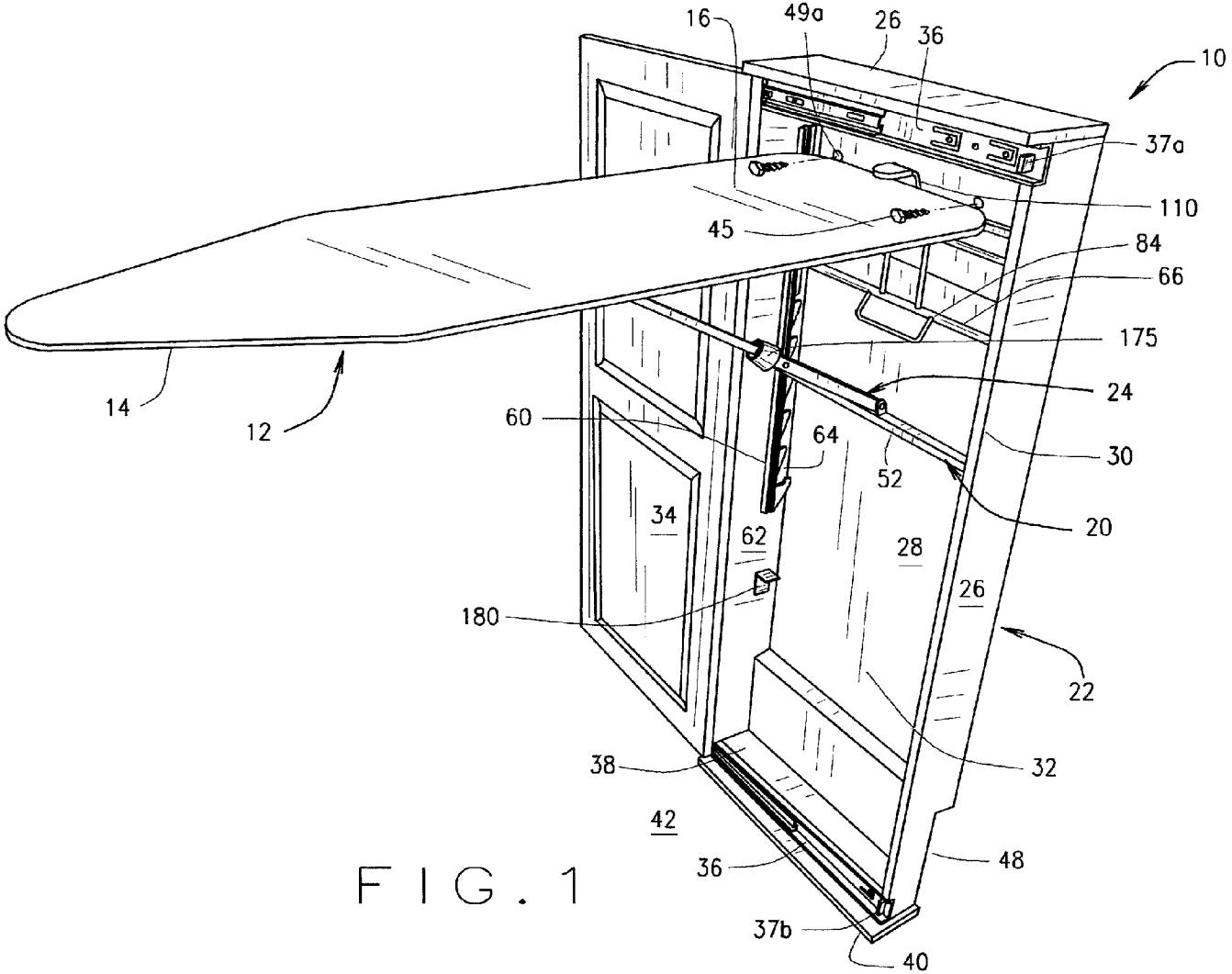
FIG. 1 is a perspective view of an ironing board storage device assembly in an operating position.
Figure 2:
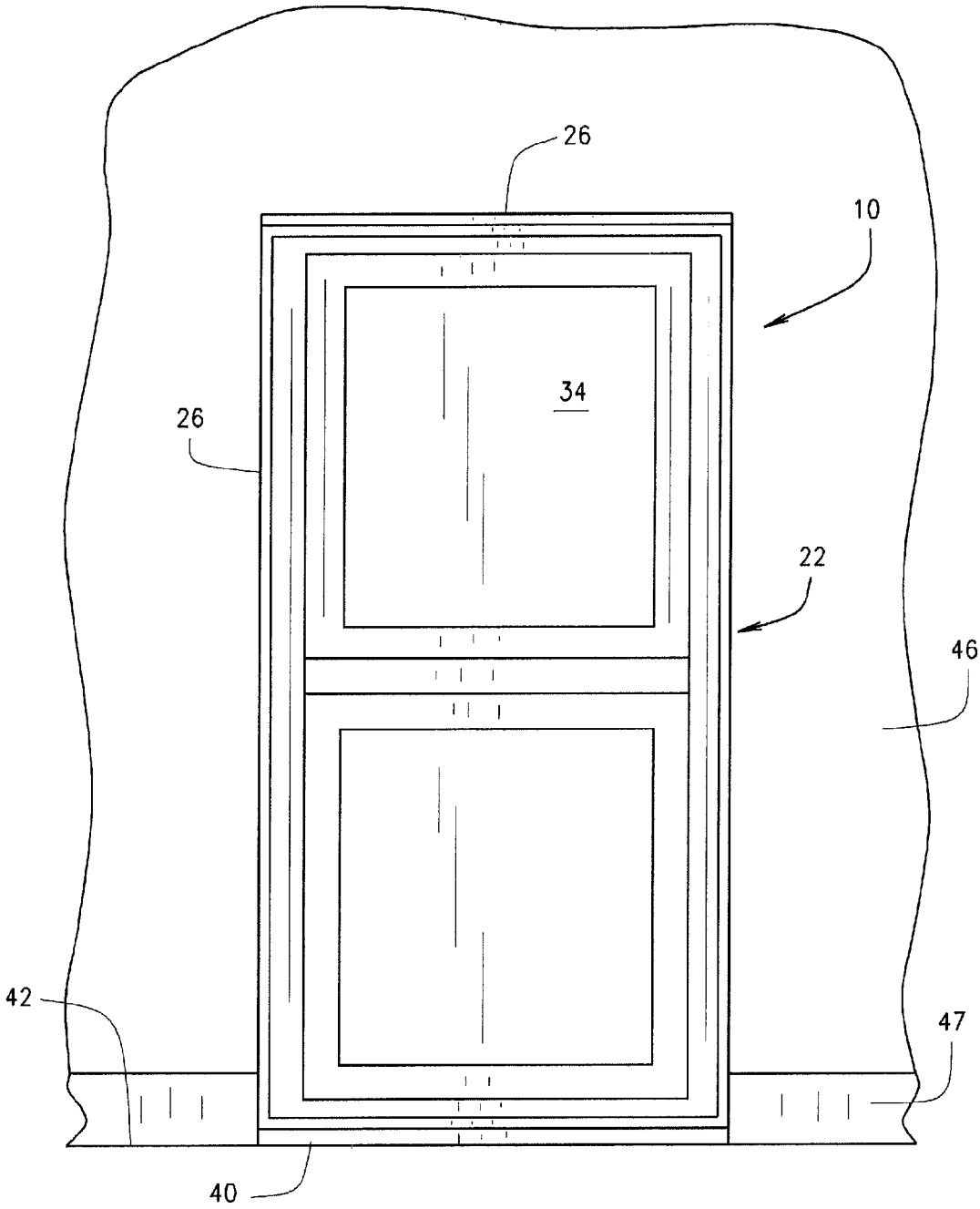
FIG. 2 is a front elevation view of the ironing board storage device assembly in a storage position.

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention. Additionally, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

As shown in FIGS. 1-14, an embodiment of the present invention, generally referred to as a ironing board storage device assembly 10, includes an ironing board 12 with a distal end 14 and a proximal end 16 moveably mounted, preferably pivotally, to a vertically adjustable frame assembly 20 mounted within a housing 22. An adaptable support assembly 24 operatively engages with the frame assembly 20 and the ironing board 12 for movement of the ironing board 12 between a storage position and an operating position. In the storage position shown in FIG. 3, the board 12 is vertical with the distal end 14 positioned beneath the proximal end 16. In the generally horizontal operating position (FIG. 1) the proximal board end 16 is closer to the housing 22 than the distal end 14. In addition, the support assembly 24 secures the ironing board 12 in the operating position.

The housing 22 is a generally rectangular box having sidewalls 26 extending from a rear panel 28 to define a front face 30 and a cavity 32 for storing the ironing board 12. Rear panel 28 has a back or outer surface 29, and a front surface 31. A door 34 is moveably mounted to the housing 22 with door slides or tracks such as upper track 36*a* and lower track 36*b*, which can be drawer slides or the like, so that the door 34 slides between an open position and a closed position across the front face 30 of the housing 22. Stops 37*a* and 37*b* are located at the end of each slide 36*a* and 36*b*, respectively, to prevent the door 34 from sliding too far. Although the embodiment of FIGS. 1-14 discloses the door 34 mounted for sliding from right to left to arrive at the open position, those skilled in the art will recognize that the door 34 can also be mounted for sliding from left to right to arrive at the open position, or a combination of both. Moreover as will be later described, the tracks 36*a* and 36*b* can have their positions reversed from top to bottom, and bottom to top, so that the direction of the door 34 sliding away from the housing 22 can be reversed. Also, those skilled in the art will recognize that the door 34 can also be mounted to the housing 22 using any method known in the art, such as hinges. In alternate embodiments, the door 34 can be removed altogether or replaced with various coverings to visually hide the interior of the housing, such as a collapsible screen or panel, a retractable shade, bi-fold door, and the like.

Figure 5:
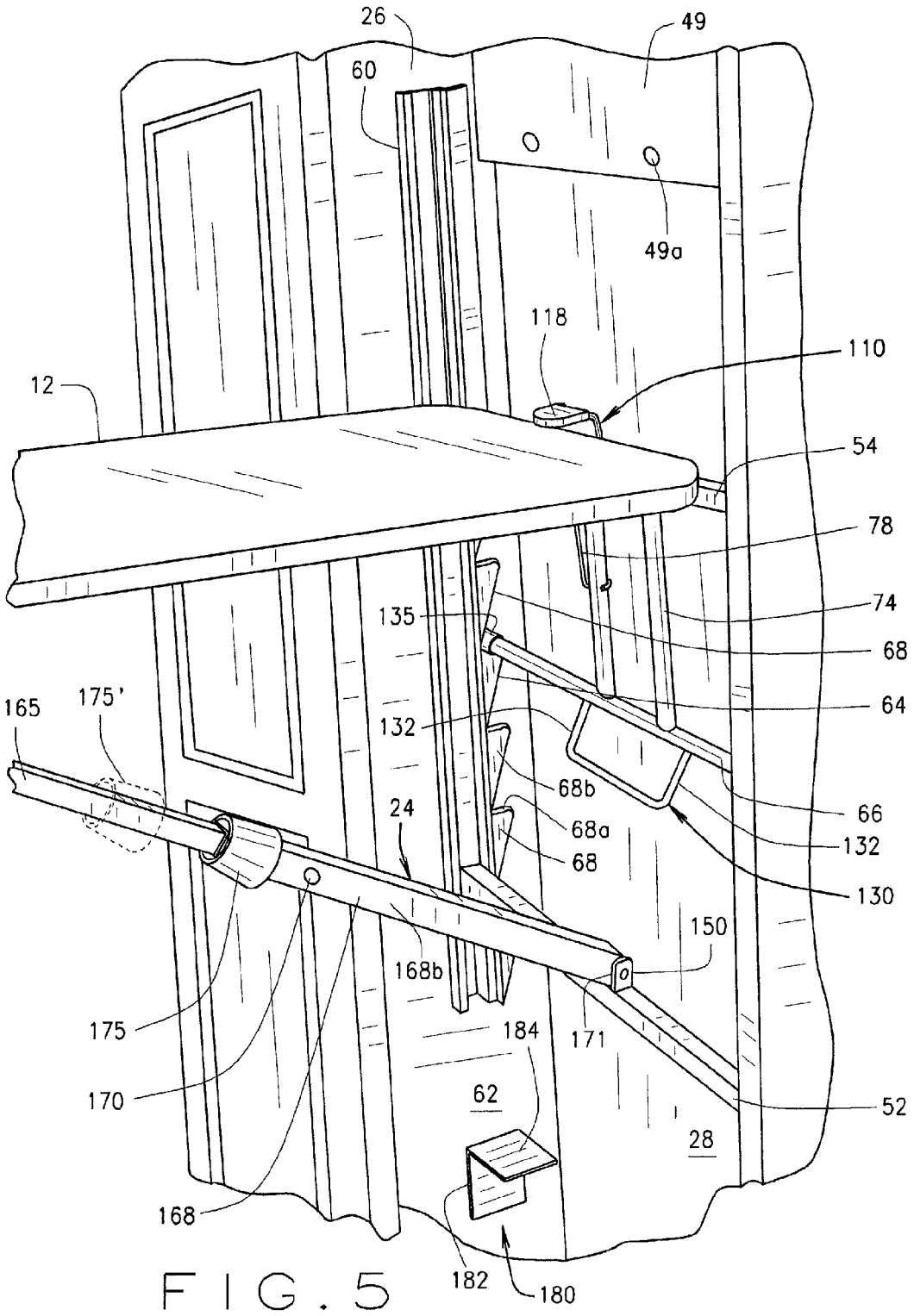
FIG. 5 is an enlarged perspective view of a frame assembly of the ironing board storage device assembly in an operating position with a securement member in a removed position.

When installed, a housing bottom surface 40 can rest on a surface, such as support surface 42, which is preferably a floor, with the rear panel back surface 29 abutting a wall 46. A plurality of spacers 41 are attached to the bottom surface 40, such as at each corner, to elevate the bottom surface 40 off the support surface 42, preferably about ¼" to allow drying of any potential moisture. The interior cavity 32 has a bottom surface 38. Wall 46 has lower molding 47. The rear panel back surface 29 can define a channel or recess 45 configured for receiving the molding 47, so the storage device 10 can abut flush against the wall 46. Because the housing 22 rests on the support surface 42, the storage device 10 can be secured to the wall 46 with a minimal amount of fasteners 45, such as heavy drywall screws shown in FIG. 1 for mounting to studs in the wall. If studs in the wall are not available smaller toggle bolts with washers, anchor bolts, nails, and the like, can be used. The housing can have an upper reinforcement beam or board 49 with holes 49*a* for receiving the fasteners 45 (FIGS. 1 and 5). This allows the storage device 10 to be easily removed while only leaving small holes from the fasteners 48, which can easily be repaired. In addition, the placement of the storage device 10 is not limited by the location of any support studs within the wall 46.

The frame assembly 20 includes a generally rectangular frame member 50 having generally horizontal lower and upper tubular members 52 and 54, respectively connected by generally vertical side or outer members 56 and 58, for supporting the ironing board 12, and support 24 (FIGS. 4, 7-8, and 13). The outer members 56 and 58 are moveably attached to the housing 22 with frame slides or tracks 60, such as with rollers 61 attached with fasteners 63 (FIG. 13), or with a drawer slide or the like. The slides 60 can each have a channel cross section with a front sidewall 60*a* and a rear sidewall 60*b* connected by a generally perpendicular mid-wall 60*c*. A flange 60*d* can extend rearwardly from the outer end of each of the slides' rear sidewalls 60*b*. At its upper end, the rear edge of flange 60*d* extends parallel to, and near, the front surface of reinforcement beam 49. The slides 60 are mounted generally vertically along the inner face of the sidewalls 62, as by screws extending through each of the slide's midwalls 60*c*, and by screws extending through the flanges 60*d* and through spacer sleeves to the outside of the flanges 60*d*. The frame 50 can slide upwardly and downwardly between different elevations relative to housing 22.

Figure 7:
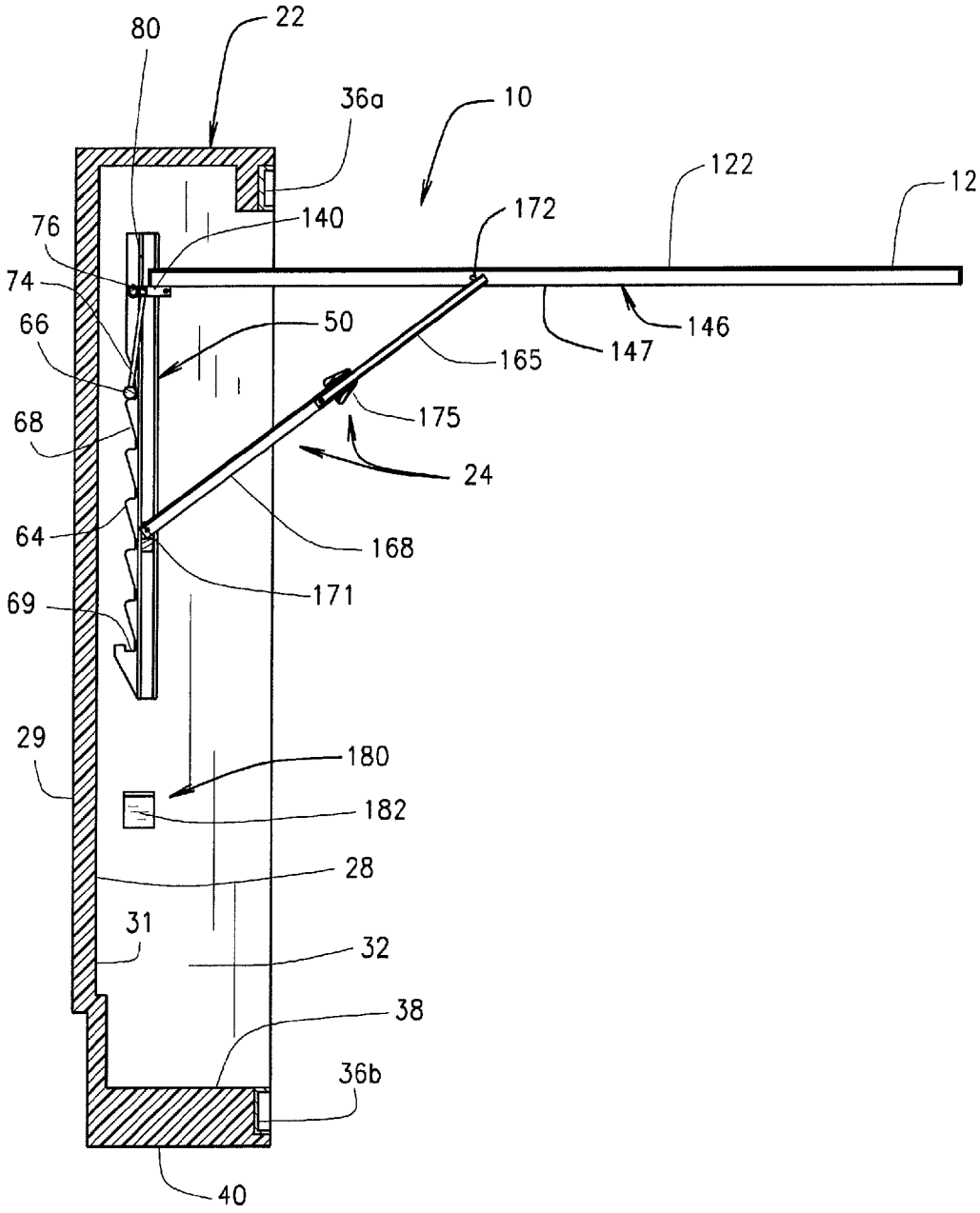
FIG. 7 is a section view of the ironing board storage device along A-A of FIG. 4 with the ironing board in an operating position, and with the pawl shown located above the uppermost detent of the ratchet.
Figure 8:
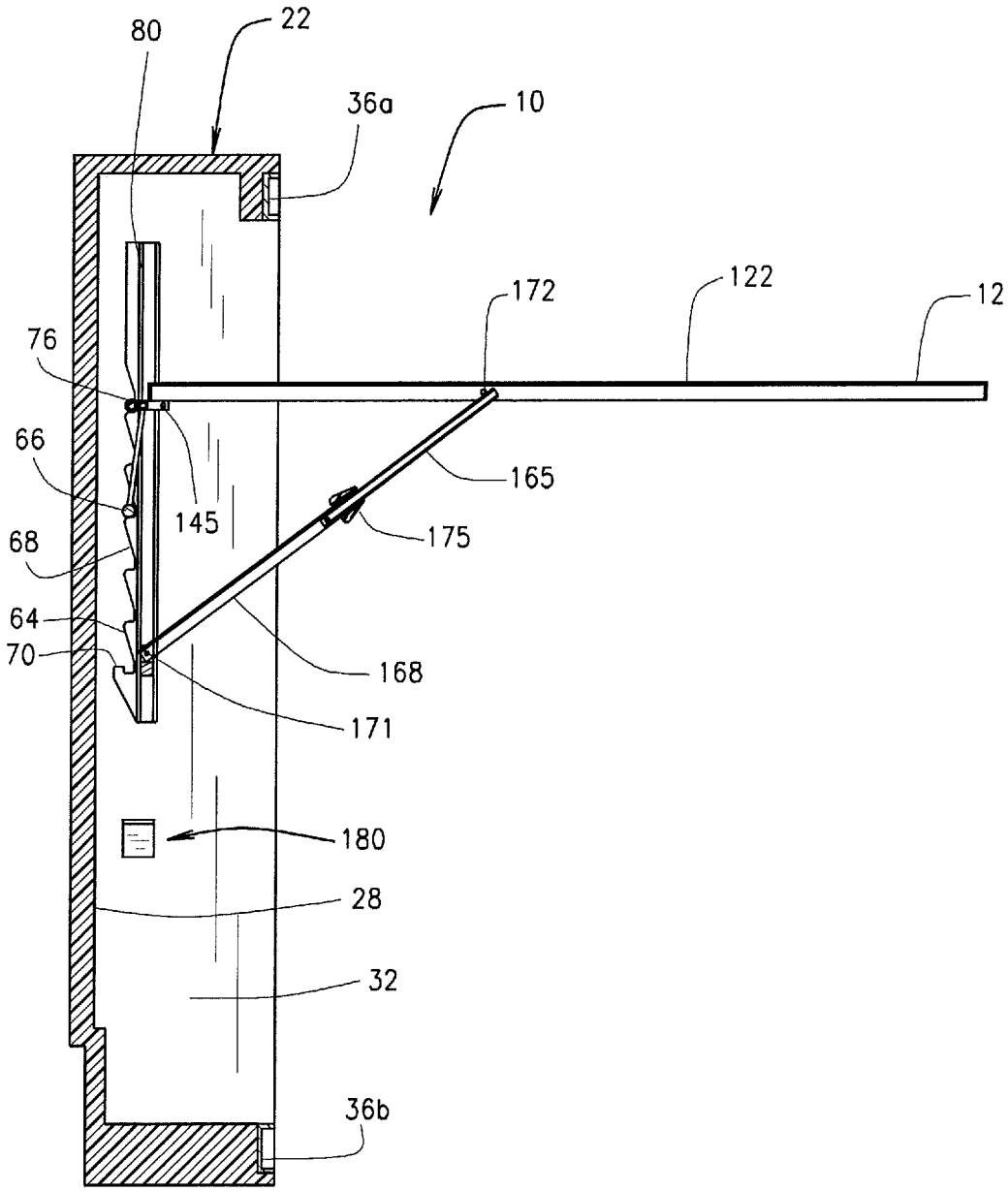
FIG. 8 is a section view of the ironing board device assembly similar to that shown in FIG. 7, but with the pawl shown located against a lower positioned detent of the ratchet so that the ironing board is in a lower position than as shown in FIG. 7.

The frame assembly 20 also includes a positioning device, such as a ratchet 64 and pawl 66 (FIG. 5), capable of positioning and securing the frame member 50 at different elevations (FIGS. 7 and 8). In the preferred embodiment, the ratchet 64 is shown as a vertical rack formed in both of the rear flanges 60*d*. The ratchet 64 includes detents formed in flanges 60*d*, such as sloping teeth 68, which are positioned at multiple elevations to engage the pawl 66. The teeth 68 each have a generally horizontal upper edge 68*a* which at its distal end angles downwardly and inwardly to form a sloping edge 68*b*. The detent at the lowest elevation is shown with a notch 69 formed in flange 60*d*, and an upwardly projecting tooth 70 located to the rear of notch 69. Notch 69 and tooth 70 hold the pawl 66 securely within the notch 69 when the pawl 66 and frame 50 are in the lowest position.

Figure 6:
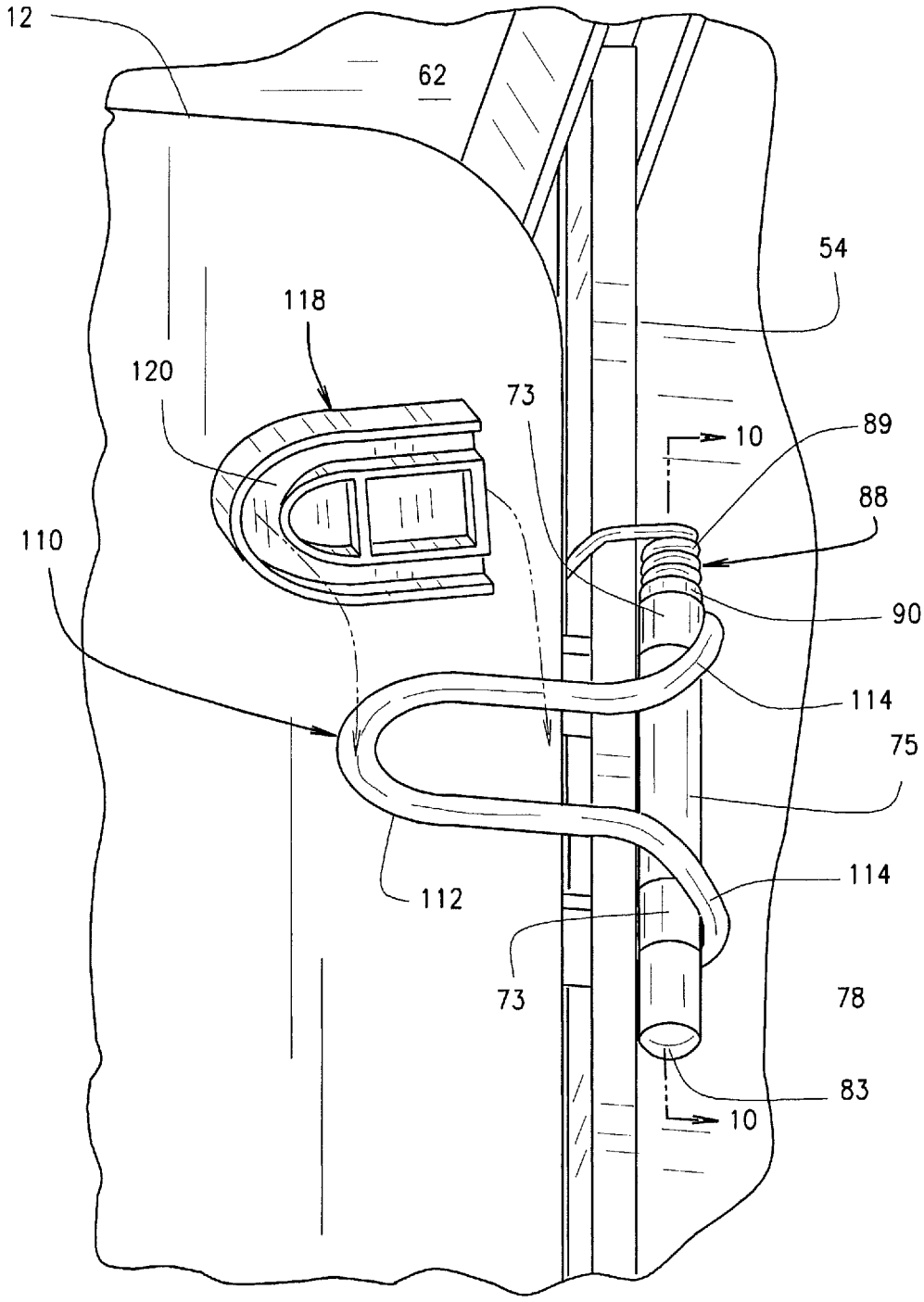
FIG. 6 is an enlarged perspective view of the upper horizontal frame member and pivotally mounted handle for the pawl and ratchet assembly, with an exploded view of the handle cover.
Figure 9:
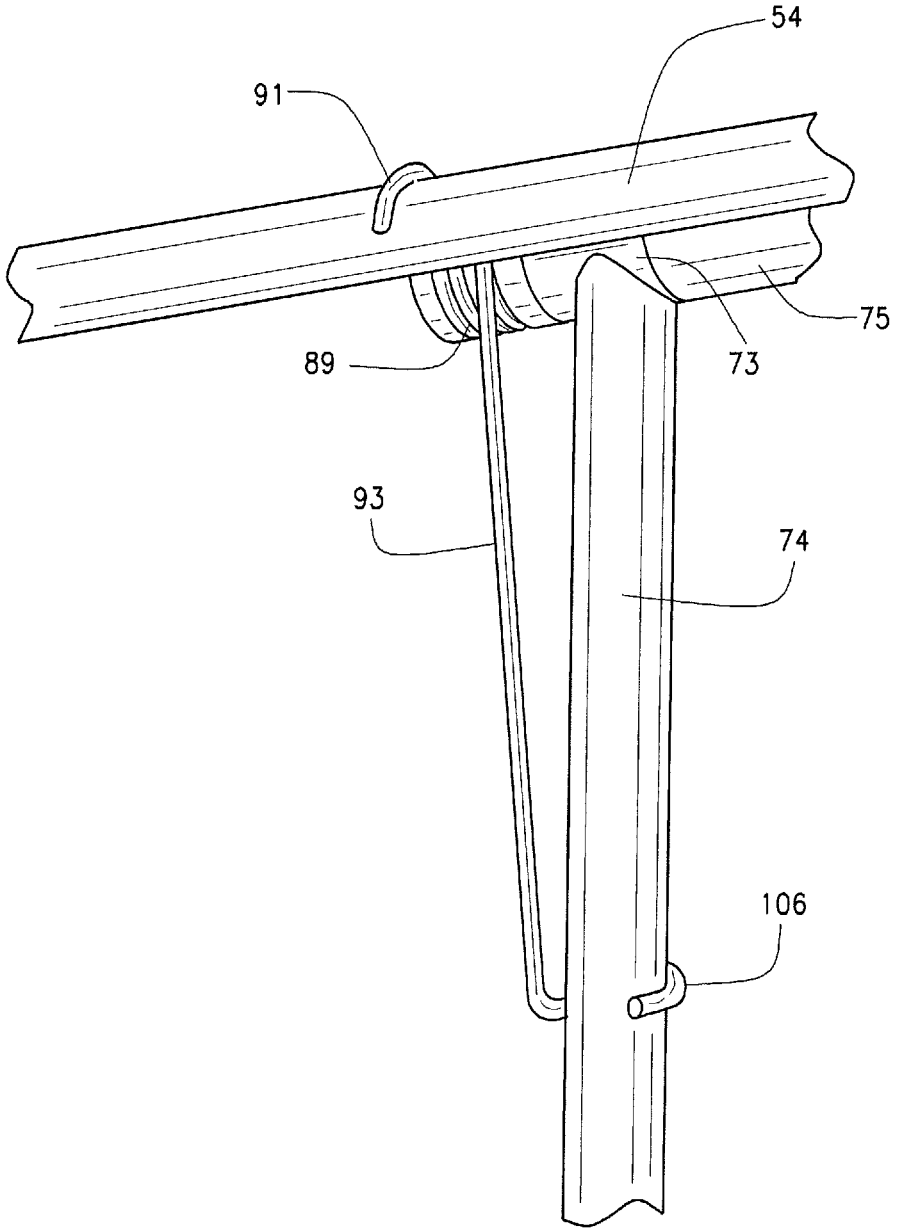
FIG. 9 is an isometric view showing parts of the frame upper horizontal member, the bearing sleeve attached to the rear of the horizontal member, and a vertical bar and bushing mounted about a pivot shaft, with a torsion spring assembled therewith.
Figure 10:
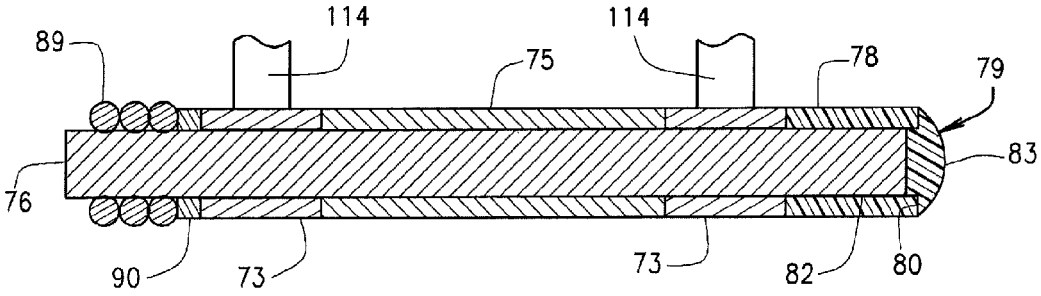
FIG. 10 is a section taken along the line 10-10 of FIG. 6.

The pawl 66 comprises a bar which is attached to the lower ends of a pair of generally vertical bars 74, as by welding (FIG. 5). Each vertical bar 74 has an upper end that terminates to be secured, as by welding, to a generally cylindrically configured hollow bushing 73 (FIG. 9). A cylindrical sleeve 75 is attached to the rear portion of the upper frame member 54, as by welding (FIGS. 6, 9 and 10). Sleeve 75 and bushings 73 have approximately the same inner and outer diameters. Both the bushing 73 and sleeve 75 have a bore shaped and sized to telescopically and pivotally receive a shaft 76, as seen more clearly in FIG. 10. Pawl 66 can thus pivot relative to the frame member 50. At one end of the shaft 76 (shown to the right in FIG. 10) the shaft 76 extends through the bore of a generally cylindrical plastic sleeve 78. A plastic cap 79 fits in the sleeve bore at its outer end. Cap 79 has an annular ledge surface 80 at its inner end, with a generally cylindrical plug 82 projecting there from. Plug 82 fits snugly within the bore of sleeve 78 to be held therein. The annular ledge surface 80 abuts the outer circular end of sleeve 78. The outer cap surface 83 has a generally curved shape.

A biasing element, such as a torsion spring 88, includes a coil 89 that extends about shaft 76 at the end of shaft 76 opposite that of sleeve 78 (FIG. 9). A washer 90 has an outer diameter of approximately that of the bushing 73 and sleeve 75, and a bore approximately the size of the bore through bushing 73 and sleeve 75. Washer 90 is positioned between the spring coil 89 and the outer end of bushing 73, as seen in FIG. 10. Torsion spring 88 has an upper finger 91 that is shaped to conform to the contour of the outer surface of upper member 54 to fit there against. A lower spring finger 93 extends generally downwardly from the opposite end of the coil 89 and is generally parallel with one of the vertical bars 74. The lower end of finger 83 extends into a U-shaped loop 106 that fits about vertical bar 74, to bear there against. The engagement of upper spring finger 91 against member 54, and the engagement of loop 106 of lower finger 93 about vertical bar 74, enables the spring 88 to bias the pawl 76 in a direction away from the rear panel member 28 and toward the ratchet 68. In alternate embodiments, the torsion spring 98 can be replaced with other appropriate biasing elements and structured to orient biased movement of the pawl 66 inwardly towards the rear panel 28 and into engagement with the ratchet 64, such as, extension springs, conical springs, helical springs, leaf springs, spiral springs, cantilever springs, gas springs, Belleville springs, rubber bands, and the like.

As seen more particularly in FIGS. 5, 6 and 10, a handle 110 is positioned toward the upper end of frame 50. Handle 110 has a generally U-shaped section 112, which is positioned to extend generally horizontally when in the engaged position with the pawl 66. The legs of the U-shaped section 112 bend downwardly into extensions 114 which have lower ends that are secured firmly to the rear portions of the bushings 73. A cover 118, which can be of plastic or rubber-like material, has a generally flat upper surface. Referring specifically to FIG. 6, the underside of cover 118 has a generally U-shaped groove 120 configured to snugly receive the horizontal U-shaped portion 112 of handle 110. The handle 110 can thus be operated so that by pushing it downwardly towards the ironing board 12, the bushings 73 rotate relative to sleeve 75, to move the pawl 66 (which is connected to the bushing 73 through bars 74), away from the ratchet 68 to disengage ratchet 68.

A second lower handle 130 also is operable to move the pawl 66 into, and out of, engagement with the ratchet 68. Handle 130 is generally U-shaped with parallel side legs 132 whose upper ends are secured firmly, as by welding, to the pawl 66. Handle 130 can be engaged by the user to pivot the pawl 66 between engaged and disengaged positions with ratchet 64. The location of handle 130 beneath board 12 allows handle 130 to be operated by a person seated in a wheelchair, and thus is beneficial to handicapped persons facing challenges.

The outer ends of pawl 66 extend through the bores of cylindrical rubberlike or plastic sleeves 135. Sleeves 135 have a length such that the outer surface of each sleeve 135 will engage against the ratchet detent upper edges 68*a*. The sleeves 135 thus provide a cushioning effect when seated there against, and reduce noise.

In the engaged position, the torsion spring 88 biases the pawl 66, in a direction away from the front surface 31 of panel 28, so that the pawl 66 engages against an upper ratchet detent edge 68*a* to secure the frame member 50 at a predetermined elevation. In the disengaged position, a user moves either of handles 110 or 130 to overcome the bias of torsion spring 78 and move the pawl 66 toward the rear panel 28 to disengage pawl 66 from the ratchet 68 and allow the frame member 50 to slide upwardly and downwardly between different elevations. In this way, the user can operate either of the handles 110 or 130 to adjust the elevation of the frame assembly 20 and ironing board 12 to a predetermined elevation, such as the highest elevation shown in FIG. 7 and the lowest elevation shown in FIG. 8. It should be noted that the sloping edge 68*b* allows the operator to grasp board 12 and move it upwardly to thus move the frame member 50 upwardly, without the user engaging either handle 110 or 130. This occurs because the pawl cover sleeves 135 are directed to move along the sloping edges 68*b*. However, once the pawl 66 is positioned above a selected one of the teeth 68, the force of gravity allows detent upper edges 68*a* to engage pawl sleeves 135 to prevent downward motion of the frame member 50 (unless the user pivots the pawl 66 to the disengaged position).

Those skilled in the art will recognize that any number of ratchet detents can be used and any number of predetermined elevations can be used. Also, the detents can be any appropriate shape or size that engages the pawl 66. In addition, other embodiments of the ratchet and pawl can be used, such as a rack and pinion.

The ironing board 12 is embodied as a typical ironing board with a generally rectangular proximal portion 14 and a generally narrowing nose distal portion 16, such as a narrowing nose, the proximal portion 14 being moveably mounted, preferably pivotally, at an upper end of the cavity 32 and supported by the support 18. However, those skilled in the art will recognize that any shape of ironing board can be used. A cover 120 fits over the ironing board 12 and includes a binding (not shown), including but not limited to a bungee cord, elastic, or drawstring, positioned around the perimeter of the cover 90 for securing the cover 120 to the ironing board 12. The cover 120 can be made of cotton as known in the art, or can be made from material with burn/scorch resistant characteristics, such as disclosed in U.S. Pat. No. 5,566,481. In other embodiments, the cover 36 includes multiple layers of materials, including but not limited to a layer of foam padding.

Figure 13:
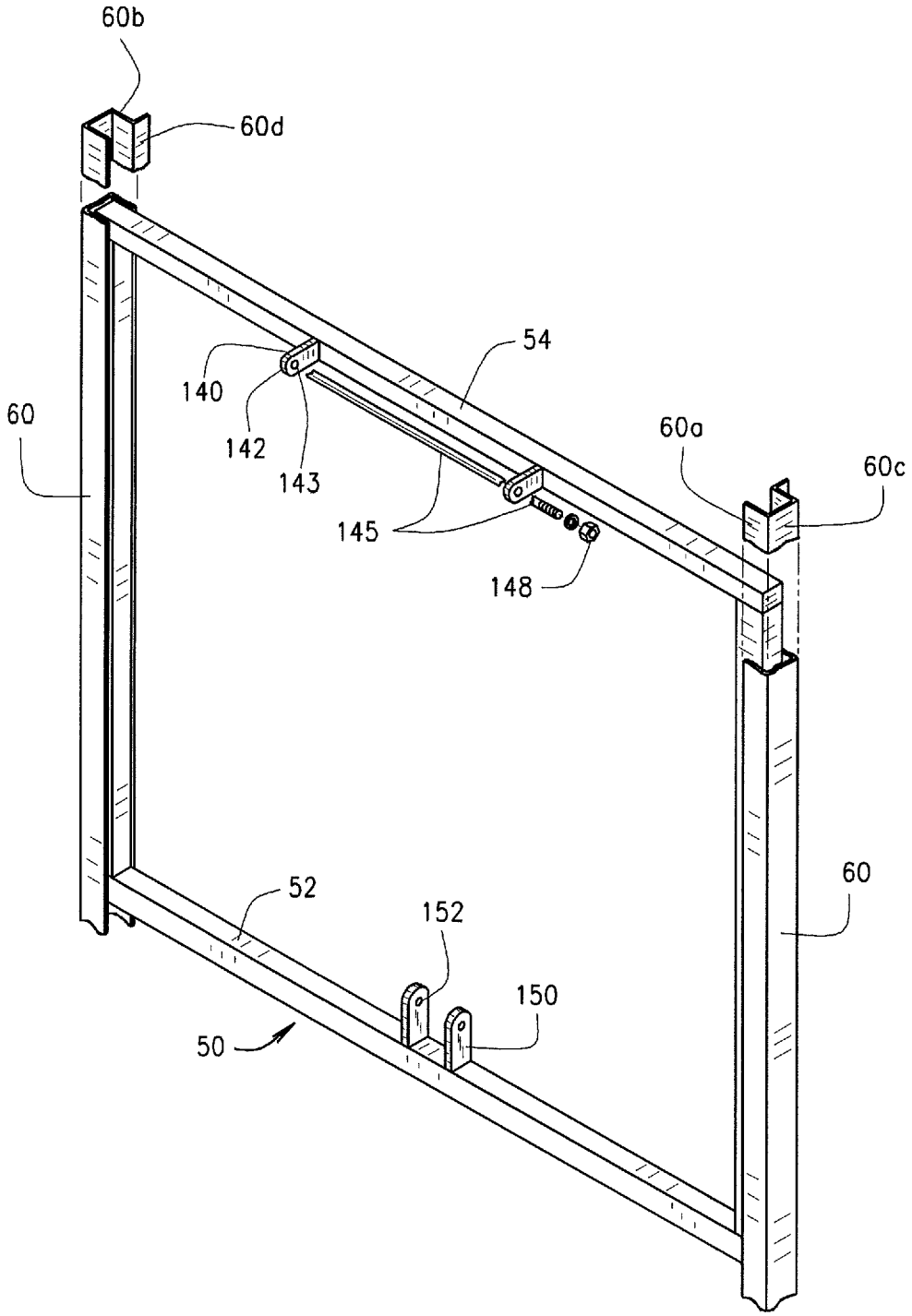
FIG. 13 is an isometric view of a frame positioned so that its side vertical members can slide within slides that are mounted to the housing.

As shown in FIG. 13, the upper horizontal tubular member 54 of frame 50 has a pair of flanges 140 projecting forwardly in a direction away from rear panel 28. The proximal ends of flanges 140 are secured as by welding, with tube member 54 to be rigidly connected thereto. The distal ends of flanges 140 can have a semicircular shape. Near the distal ends of the flanges 140 are bores 143 that can receive a horizontal rod 145 having threaded outer ends.

Figure 14:
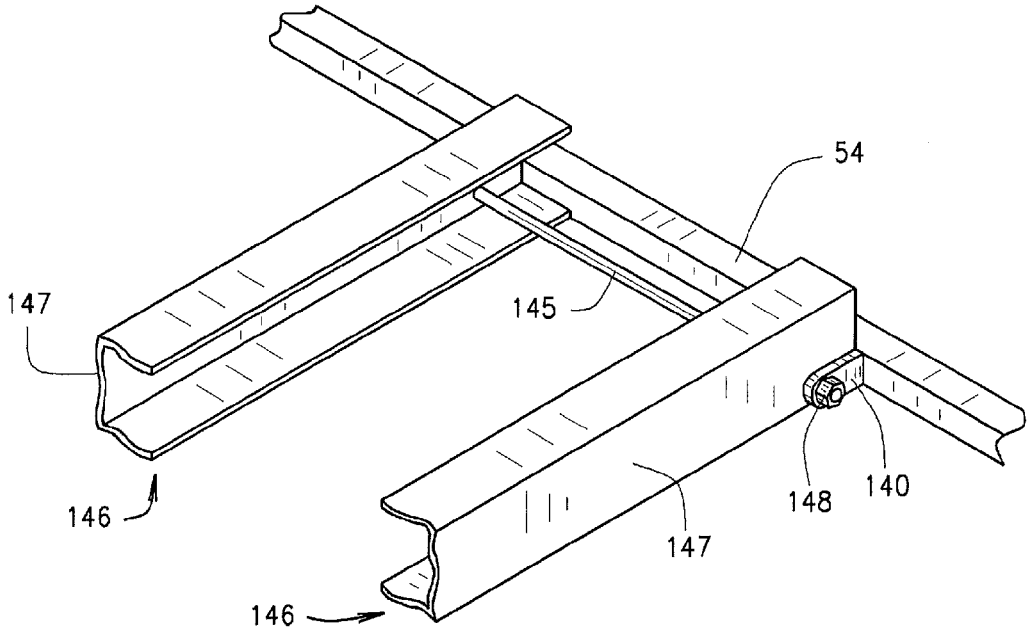
FIG. 14 is a broken isometric view showing part of the upper frame horizontal member with flanges extending therefrom in pivotal connection with the proximal ends of the ironing board longitudinal struts.

The ironing board 12 has a pair of central channel shaped longitudinal struts 146, as shown in FIG. 14. The rod 145 extends through bores in mid plate 147 of each strut 146, and through the flange bores 143, with washers and nuts 148 extending about the rod's threaded ends, one such end being shown to the right of rod 145 in FIG. 13. This allows the proximal end of the ironing board 12 pivots relative to the flanges 140 and upper member 54.

Also as seen in FIG. 13, the lower horizontal frame member 52 has secured, as by welding, to its upper surface a pair of generally vertical flanges 150. Each flange 150 has a bore 152 extending near its outer ends.

All of the described parts of the support 24 are preferably of metal, such as of stainless steel or aluminum. They could be, however, of durable plastic or other suitable material.

A heat-resistant and waterproof panel can be secured to the ironing board cover 122, such as the panel disclosed in U.S. Pat. No. 7,082,705, hereby incorporated by reference, for preventing damage to the cover 122 by an iron (not shown). When the iron is placed with an ironing surface facing the panel, the iron is supported by protuberances so that a gap is formed between the ironing surface and the iron to allow steam to flow through the gap about the protuberances and condense in the basin. Those skilled in the art will recognize that other heat-resistant and/or waterproof panels can be used. The panel can be generally rectangular shape secured to a rear portion of the cover 122, or other shapes, including but not limited to circular, trapezoidal, or oblong can be provided. Further, other sizes and locations can be used. If desired, the ironing board storage device 10 can be used without the waterproof panel.

The support 24 includes a bar 165 and a bar 168. Bar 165 has its outer end pivotally connected to ironing board 12, while bar 168 has its outer end pivotally connected to the frame assembly 20, as will be later described. The Bar 165 is preferably of smaller diameter than bar 168 so that it can fit within bar 168. The two bars 165 and 168 have their inner ends pivotally connected by a fastener 170, such as a pivot member depicted as a rivet.

The bar 165 is depicted as preferably of a square or rectangular cross section, with a pair of parallel side walls 165*a* and 165*b*, and upper and lower walls 165*c* and 165*d*, respectively. Bar 168 is shown preferably to have a generally channel-shape with side walls 168*a* and 168*b*, and an upper midwall 168*c*. The bar 165 is sized so that it inner end fits within the channel sidewalls 168*a* and 168*b* when the support 24 is in its extended operating position, as preferably depicted in FIG. 12. Preferably, the fit is snug so that the bar 165 side walls 165*a* and 165*b* fit parallel to and flush against the inside surfaces of bar sidewalls 168*a* and 168*b*, and bar 165 upper wall 165*c* upper surface fits parallel and flush against the inside surface of channel mid-wall 168*c*, so that the wall 168*c* and wall 165*c* abutment against each other blocks further upward pivotal movement of the board 12, as seen in FIGS. 5, 7, 11 and 12.

At its outer end, bar 168 is pivotally connected to the flanges 150 on frame tube 52 as by a rivet 171, or bolt or pin, that passes through the flange bores 152 and bar sidewalls 168*a* and 168*b*. The outer end of bar 165 has a rod 172 secured thereto as by welding. Rod 172 passes through bores in the midwalls 147 of longitudinal struts 146 to be rotatable therein, with cotter pins passing through the rod 172 to the outside of midwalls 147 to maintain the position of the rod 172 relative to struts 146.

A securement member 175 is provided to lock bars 165 and 168 in the operating position. Securement member 175 is preferably a sleeve having a generally frustoconical outer surface 175*a* and a generally frustoconical inner surface 175*b*, so that a generally frustoconically shaped bore 175*c* extends there through. In such an extended operating position such as depicted in FIGS. 1, 4, 5, 7, 8, 11 and 12, the securement member 175 fits over the pivotally connected inner ends of the bars 165 and 168 to lock them in position to prevent pivotal movement, and to secure the ironing board 12 in the operating position.

Figure 11:
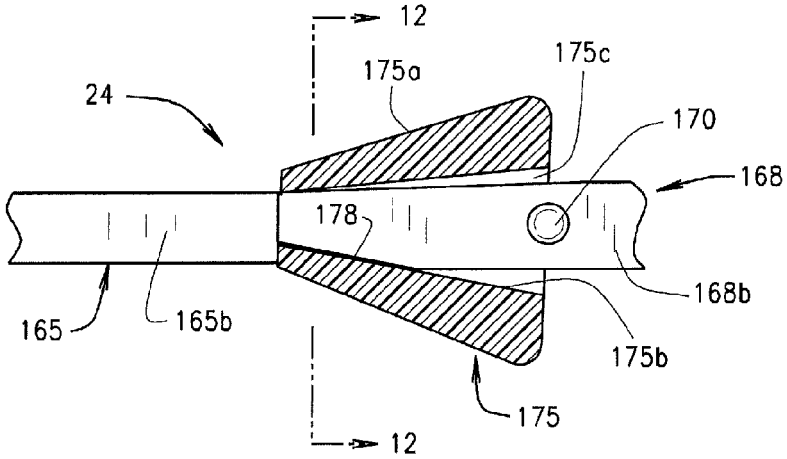
FIG. 11 is an elevation, partly in section, of a securement member extending about a support brace that extends from the ironing board to the housing.
Figure 12:
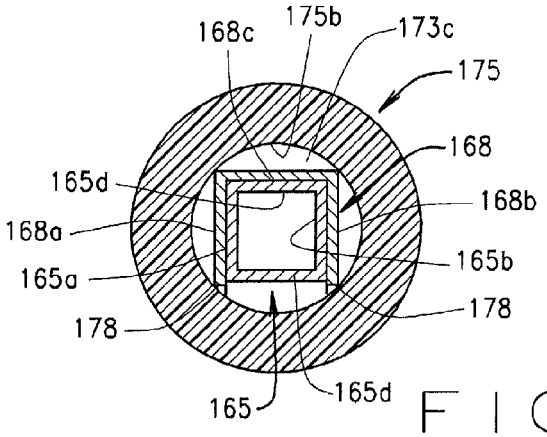
FIG. 12 is a section of the supporting brace structure and securement member taken along the line 12-12 of FIG. 11.

At its distal end, the bottom edges of sidewalls 168*a* and 168*b* of bar 168 have tapered or curved lower edges 178 so that the height of sidewalls 168*a* and 168*b* decrease in height from the beginning of the slope of the tapered or curved section toward the distal end of bar 168. Thus when the user grasps the ironing board 12 to pivot it upward to align the bars 165 and 168 with each other as seen in FIGS. 1, 4, 5, 7, 8, 11 and 12, securement member 175 slides downwardly along bar 165 under the force of gravity from a higher position such as depicted in phantom lines at 175' in FIG. 5, to the position 175 of FIGS. 1, 4, 5, 7, 8, 11 and 12. In such a position the member 175 captures both bars 165 and 168 within bore 175*c* to resist pivotal movement of the bars 165 and 168 relative to each other and to lock those bars in place to prevent buckling or pivoting movement of the bars 165 and 168 relative to one another. If needed, the operator can move the member 175 by hand to be more snugly located. As seen in FIG. 11, the lower taper or curved edges 178 of sidewalls 168*a* and 168*b* rest against the frustoconical inner surface 175*b* of member 176. Such a fit provides good holding stability of member 175 to keep the bars 165 and 168 in their locked position. If the bars 165 and 168 are bumped or jolted upwardly, the structure of securement member 175 acts to resist inadvertent buckling or folding of the bars 165 and 168 with resulting dropping of the board 12 and objects resting on board 12.

From such an engaged position, the support 24 and board 12 can be moved to a collapsed position for storage. The securement member 175 can be grasped by the operator's hand and slid upwardly along bar 165, such as to the phantom line position 175' of FIG. 5. Then the operator can push the member at 175' upwardly against bar 165 to cause the bars 165 and 168 to pivot about pivot member 170 so that the support 24 folds or collapses to allow the ironing board 12 to move from the operating position to the storage position of FIGS. 3 and 2. With such pivoting the bar 165 sidewalls 165*a* and 165*b* move within the sidewalls 168*a* and 168*b* of bar 168, and the bars 165 and 168 are generally vertically oriented.

A preventative arrangement against damage and impact caused by misjudged movement of the handles 110 and 130 in holding the pawl 66 in a rearward most position for too long during downward movement of board 12, so that the pawl 66 is not engaged by the lowermost detent notch 69 and tooth 70, is provided. In the preferred embodiment, a pair of stops 180 is provided. Each stop 180 is generally angle, or L shaped, with a generally vertical leg 182 that extends upwardly into a generally horizontal leg 184. The vertical stop legs 182 each have a generally flat surface that generally fits flush against the flat inner surface 62 of sidewalls 26. Each leg 182 is secured thereto as by a pair of screws. The stop leg 184 generally projects perpendicular to surface 62. Thus if the pawl 66 is held by handle 110 or 130 for too long a period of time during downward movement of board 12 and frame assembly 20 so that pawl 66 skips over the ratchet teeth 68 and ratchet bottom tooth 70 and notch 69, the bottom cross bar 52 of frame 50 will engage the upper surface of stop horizontal legs 184 to halt downward movement of frame assembly 20 and board 12.

In the storage position, the pawl 66 should be positioned to rest on upper edge 68*a* of the uppermost ratchet tooth 68 of the ratchet. In such position when the ironing board 12 pivots downwardly to the position of FIG. 3, the board's distal end 14 will be positioned above the lower surface 38 of housing cavity 32.

Figure 3:
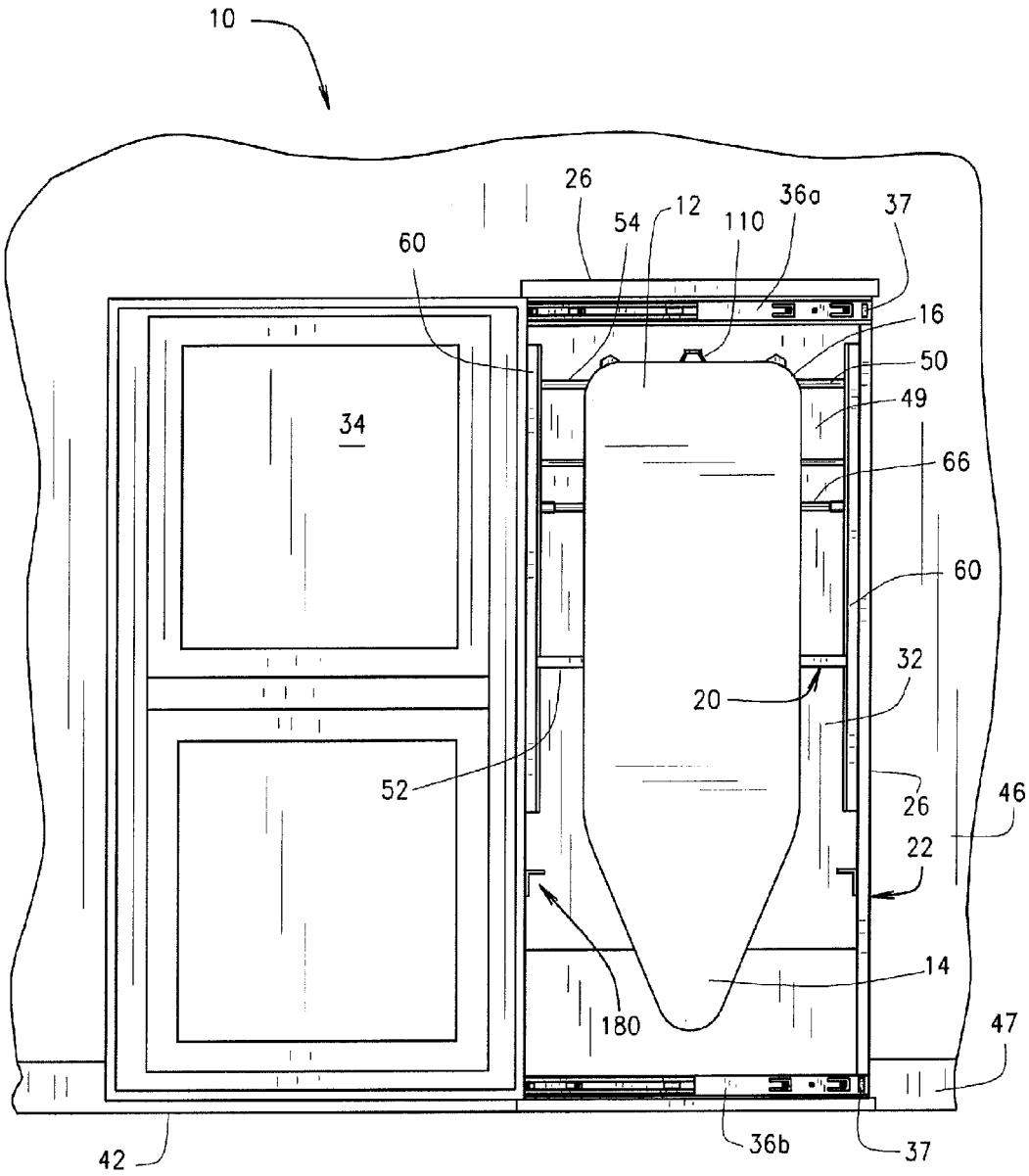
FIG. 3 is a front elevation view of the ironing board storage device assembly with a door in an open position and the ironing board in the storage position.
Figure 4:
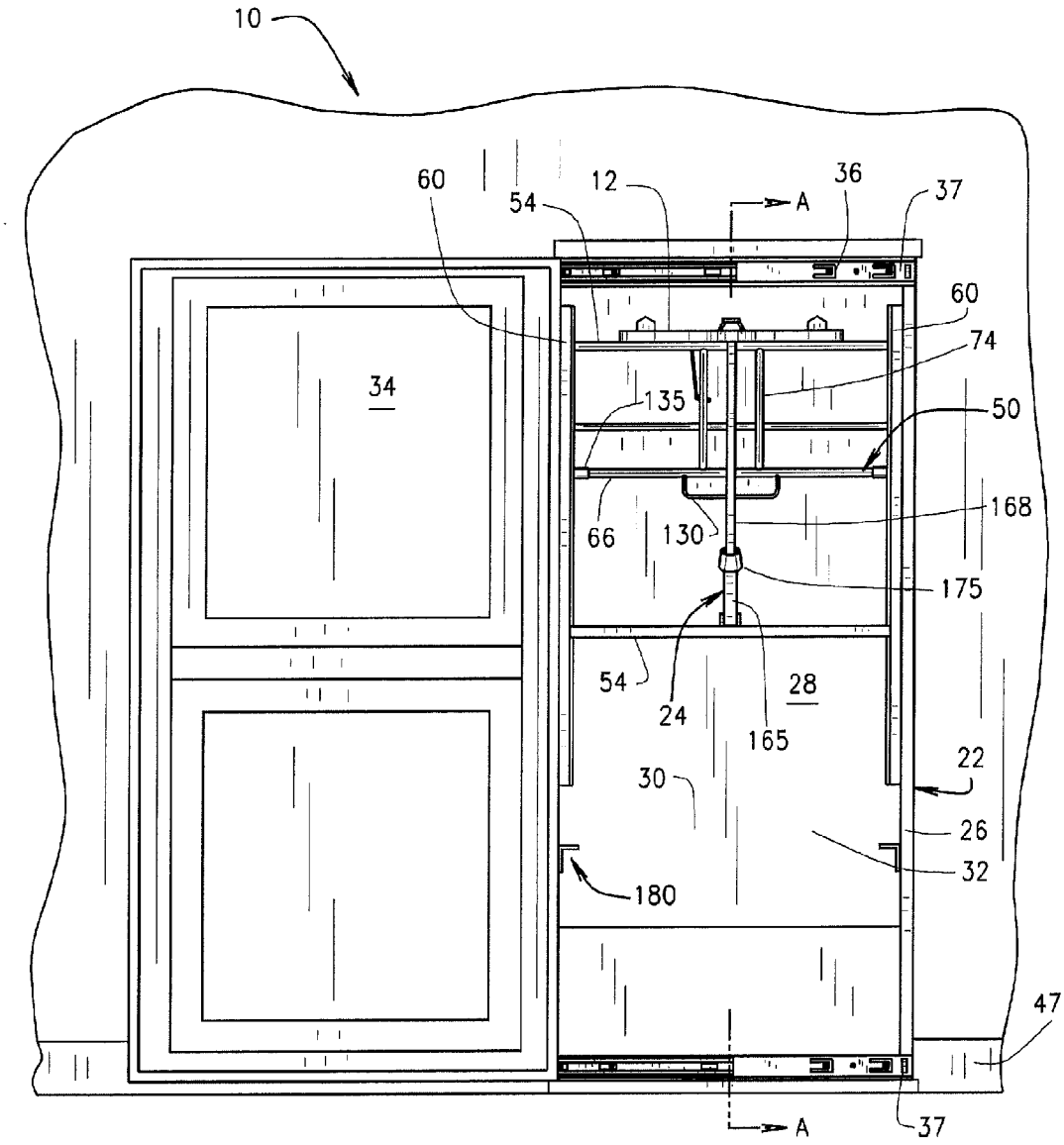
FIG. 4 is a front elevation view of the ironing board storage device assembly in the operating position.

As noted earlier, the tracks 36*a* and 36*b* at the top and bottom of the housing 22 slideably support the door 34. The tracks 36*a* and 36*b* are held to the wooden crossbeams at the top and bottom of the housing 22 as by screws. Those screws can be removed, and the track 36*a* at the top moved to be at the bottom where track 36*b* originally was, and the track 36*b* at the bottom moved to be at the top where track 36*a* originally was, and both be secured again as by screws. The position of the door 34 can be reversed top to bottom so that what was initially the door top becomes the bottom, and what was the bottom becomes the top. The door 34 can then be slideably mounted to the tracks 36*a* and 36*b* in their new reversed positions. The stops 37*a* and 37*b* are likewise reversed in position, so that the stops 37*a* and 37*b* which were initially located to the right when viewed looking at FIG. 1, are in the reversed position located to the left. By doing this, the door 34 can in its reversed position slide from the left to right to open, and thus moves to an open position that is the opposite of what is shown in FIGS. 1 and 3. This allows adjusting the door 34 position to be best located according to the surrounding structure, which surroundings may block sliding the door 34 in one direction, or make the door 34 sliding in a certain direction inconvenient.

In summary, and in view of the previous discussed operational steps and advantages which will not now be repeated, the operator slides the door 34 to the open position to access the ironing board 112, as shown in FIG. 3. The operator manually raises the ironing board 12 from the generally vertical storage position to the generally horizontal operating position of FIG. 7, and the securement member 175 slides by force of gravity over the pivoting inner ends of the support 24, to hold support assembly 24 in the locked operating position of FIG. 7. The operator engages one of the handles 110 and 130 to pivot the pawl 66 out of engagement with the ratchet 64, and moves the frame assembly 20 and ironing board 12 upwardly or downwardly to a desired elevation and an appropriate position for ironing. Once the desired elevation is selected, the handles 110 or 130 are disengaged and the pawl 66 engages the ratchet 64 to an engagement position, to secure the ironing board 12 at the selected operating height. To return the device 10 to the first height position, the operator slides the frame assembly 20 upwardly or downwardly until the ironing board 12 is located at an appropriate elevation for storage. Then, the operator slides the securement member 175 from the pivoting ends of the support 24, the removed position, and manually pivots the ironing board 12 from the operating position to the storage position and, then slides the door 34 to the closed position.

Changes can be made in the above constructions without departing from the scope of the invention, it is intended that all matter contained in the above description or shown in the accompanying drawings shall be interpreted as illustrative and not in a limiting sense.

What is claimed is:

1. An ironing board storage device assembly, comprising:

a housing, the housing having first and second side walls;

a frame assembly having first and second generally vertically extending side members spaced from each other, the frame having an upper horizontal member and a lower horizontal member in rigid connection relative to the first and second vertical frame side members; the first and second housing side walls having corresponding first and second tracks configured to slidingly receive the first and second frame side members, respectively, for allowing the frame assembly to slide between different elevation;

an ironing board having a proximal end and a distal end, the ironing board being pivotally connected to the frame assembly near the ironing board's proximal end, for movement between a substantially vertical storage position wherein the ironing board proximal end is above the ironing board distal end, and a substantially horizontal operating position wherein the ironing board proximal end is closer to the housing than the ironing board distal end;

a support brace comprising a first brace bar member and a second brace bar member, the first and second brace members each having an outer end and an inner end, the first brace member near its outer end being pivotally connected to the frame assembly, the outer end of the second brace member being pivotally connected to the ironing board, the first and second brace members being pivotally connected to each other to pivot in the same plane which plane is generally perpendicular to the ironing board, so that in a first extended position the first and second brace members are generally aligned with each other to extend generally in the same direction, and capable of pivoting in the same plane to a folded collapsed position; at least one of the first or second brace members having a first longer section located to one side of its pivotal connection to the other brace member, and a shorter second overlap section located to the other side of the pivotal connection to the other brace member, the configuration of the brace members allowing the first and second brace members to be capable of pivoting to the extended position with the second overlap section of one brace member extending alongside the other brace member in overlapping relationship; a securement member associated with the support brace, the securement member generally having a sleeve shape and configured to be mounted in sliding relationship to one of the brace members in an unlocked position, and configured so that when the first and second brace members are in the extended position the securement member is capable of sliding to a locked position wherein the securement member fits about and engages one brace member and fits about and engages the second overlap section of the other brace member to lock the two brace members to resist pivotal movement of the brace members relative to one another, and wherein when the first and second brace members are in a locked position with the sleeve member, the securement member is configured to be capable of sliding to an unlocked position wherein the securement member does not fit about or engage the second overlap brace member section to resist pivotal movement of the brace members to a folded position;

a positioning assembly operatively associated with the ironing board and with the frame member for positioning and securing the frame member at different elevations, the positioning assembly comprising a ratchet and pawl assembly, the ratchet having a first rack and a second rack, the first rack being mounted in association with the first housing side wall, and the second rack being mounted in association with the second housing wall, the first and second racks each having a plurality of detents located at different elevations relative to the side walls;

the ratchet and pawl assembly comprising a pawl assembly mounted to rotate relative to the horizontal frame member, the pawl assembly comprising a generally horizontal pawl bar, the pawl bar and the rack detents being configured for the pawl bar to rest above and upon rack detents to be supported thereby, at least one pawl assembly connection member extending from connection with the pawl bar to association with a pawl bushing, said bushing pivotally connected relative to the upper horizontal frame member, a generally horizontal shaft extending through the bushing, the shaft being supported by the upper horizontal frame member; a first handle connected to the bushing, the handle having a gripping portion located above the ironing board when the ironing board is in the horizontal operating position, the gripping portion being sized and configured to be capable of being grasped by a human hand to pivot the bushing and the pawl bar relative to the ratchet racks to locate the pawl bar to be supported by selected rack detents when the ironing board is in the horizontal operating position; a second handle connected to the pawl bar beneath the ironing board when the ironing board is in the extended position, the second handle having a gripping portion being sized and configured to be capable of being grasped by a human hand to pivot the pawl bar and the bushing relative to the ratchet racks to locate the pawl bar to be supported by selected rack detents when the ironing board is in the horizontal operating position; and a biasing member comprising a spring, the spring having a torsion spring section through which the shaft extends, the spring having a first extension that extends from a first part of a the torsion spring section, the first spring extension being held in a generally fixed relationship relative to the frame, the spring having a second extension that extends from a second part of the torsion spring section, the second extension being held in a generally fixed relationship relative to the pawl assembly.

2. The ironing board storage device assembly of claim 1, wherein in the extended position the second brace member is positioned to be higher than the first brace member, the securement member having a passageway extending there through, the first brace member and second brace member each having a cross section area, the cross section area of the first member towards its inner end being larger than the cross section area of the second member near its inner end, with the said securement member passageway sized to be capable of sliding the securement member from a position about the second brace member to a position to simultaneously extend about both the second brace member near its inner end and about the first brace member inner end and engage the larger cross section inner end of the first brace member to resist movement of the securement member beyond the second member, and to engage both the first brace member and second brace member to hold those brace members in the extended position.

3. The ironing storage device assembly of claim 2 wherein the securement member passageway is generally of a frustoconical shape having a tapered inner surface to have a smaller opening at its end located toward the outer end of the second brace member and to decrease in size in the direction toward the inner end of the second brace member, and wherein the inner end of the first brace member is tapered to be generally in alignment with the slope of the frustoconical inner surface of the passageway and to decrease in size towards the inner end of the first brace member.

4. The ironing board storage device assembly of claim 3 wherein the second upper brace member is configured to have wall structure and the first lower brace member is configured to have wall structure, with the wall structure of the inner end of the second brace member sized to fit within the wall structure of the inner end of the first brace member, and for the wall structure of the second upper brace member to engage the wall structure of the first lower member to resist upward pivotal movement of the second brace member when the brace members are in the extended position.

5. The ironing board assembly of claim 4 wherein the wall structure inner end of the second upper brace member has at least three walls at general right angles to each other, and the first lower brace member wall structure has a generally channeled shape configuration with three walls at generally right angles to each other and sized to snuggly receive the walls of the second brace member inner end when the brace members are in the extended position.

6. The ironing board assembly of claim 1 wherein the rack detents have a generally horizontal upper edge which at its distal end angles downwardly and inwardly to form a sloping edge; and further comprising a detent at the lowest elevation which has a notch in the rack with an upwardly projecting tooth located to the rear of notch, the notch and tooth being configured and sized to hold the pawl bar securely within the notch when the pawl bar is in the lowest position; the assembly further comprising at least one stop mounted in association with a side wall and projecting therefrom and positioned to engage the frame assembly to resist downward movement of the frame assembly.

7. The ironing board assembly of claim 6 wherein the housing further comprises:

a rectangular box shape having a front face and a cavity located between the two sidewalls and sized to contain the ironing board assembly when the ironing board assembly is in a collapsed position;

a door having a first horizontal end and a second horizontal end;

a first track capable of being releasably secured towards the top of the housing, and a second track capable of being releasably secured to the bottom of the housing, the first track and second track each having a stop located at one end of the track with the two stops being vertically aligned with each other to a first side of the housing when door tracks are in a first position;

the door having structure mounted at its first horizontal end and at its second horizontal end for sliding within the tracks so that in a first position the door is capable of sliding in a first direction to a position to expose the cavity when the ironing board assembly is in a collapsed position, and in a second direction to second position cover the cavity, with the track stops positioned to engage door structure to prevent movement of the door beyond the stops in the second when the door is in the second position;

the door tracks being configured to be capable of being detached from their first position and repositioned to a second position with the first track secured to the bottom of the housing and the second track secured to the top of the housing, with the stops of the first and second tracks in the second tracks position located to be vertically aligned to a second side of the housing opposite from their location in the first position, and the door being capable of being repositioned so that its first end in the first door positon is repositioned to slide with the repositioned first track and the door's second end is repositioned to slide with the repositioned second track so that the door can slide in a direction opposite its aforesaid first direction to expose with cavity, and slide in a direction opposite its aforesaid second direction to be in front of the cavity, with the track stops located to be capable of engaging the door structure to prevent movement of the door beyond the stops.

8. An ironing board storage device assembly, comprising:

a housing, the housing having first and second side walls;

a frame assembly having first and second generally vertically extending side members spaced from each other, the frame having an upper horizontal member and a lower horizontal member in rigid connection relative to the first and second vertical frame side members; the first and second housing side walls having corresponding first and second tracks configured to slidingly receive the first and second frame side members, respectively, for allowing the frame assembly to slide between different elevation;

an ironing board having a proximal end and a distal end, the ironing board being pivotally connected to the frame assembly near the ironing board's proximal end, for movement between a substantially vertical storage position wherein the ironing board proximal end is above the ironing board distal end, and a substantially horizontal operating position wherein the ironing board proximal end is closer to the housing than the ironing board distal end;

a support brace comprising a first brace bar member and a second brace bar member wherein in the extended position the second brace member is positioned to be higher than the first brace member, the first and second brace members each having an outer end and an inner end, the first brace member near its outer end being pivotally connected to the frame assembly, the outer end of the second brace member being pivotally connected to the ironing board, the first and second brace members being pivotally connected to each other to pivot in the same plane which plane is generally perpendicular to the ironing board, so that in a first extended position the first and second brace members are generally aligned with each other to extend generally in the same direction, and capable of pivoting in the same plane to a folded collapsed position; the first brace member having a first longer section located to one side of its pivotal connection to the second brace member, and a shorter second overlap section located to the other side of the pivotal connection to the second brace member, the configuration of the brace members allowing the first and second brace members to be capable of pivoting to the extended position with the second overlap section of the first brace member extending alongside the second brace member in overlapping relationship; a securement member associated with the support brace, the securement member generally having a sleeve shape and a passageway having a tapered inner surface to have a smaller opening at its end located toward the outer end of the second brace member and to decrease in size in the direction toward the inner end of the second brace member, so that when the first and second brace members are in the extended position the securement member is capable of sliding along the second brace member to a locked position wherein the securement member fits about and engages the first brace member and about the second overlap section of the first brace member to lock the two brace members to resist pivotal movement of the brace members relative to one another, and wherein when the first and second brace members are in a locked position with the sleeve member the securement member is configured to be capable of sliding to an unlocked position wherein the securement member does not fit about or engage the second overlap brace member section to resist pivotal movement of the brace members to a folded position.

9. The ironing board storage device assembly of claim 8, wherein the first brace member and second brace member each have a cross section area, the cross section area of the first brace member towards its inner end being larger than the cross section area of the second member near its inner end, with the said securement member passageway sized to be capable of sliding the securement member from a position about the second brace member to a position to simultaneously extend about both the second brace member near its inner end and about the first brace member inner end and engage the larger cross section inner end of the first brace member to resist movement of the securement member beyond the second member, and to engage both the first brace member and second brace member to hold those brace members in the extended position.

10. The ironing storage device assembly of claim 9 wherein the securement member passageway is generally of a frustoconical shape having a tapered inner surface to have a smaller opening at its end located toward the outer end of the second brace member and to decrease in size in the direction toward the inner end of the second brace member, and wherein the inner end of the first brace member is tapered to be generally in alignment with the slope of the frustoconical inner surface of the passageway and to decrease in size towards the inner end of the first brace member.

11. The ironing board storage device assembly of claim 10 wherein the second upper brace member is configured to have wall structure and the first lower brace member is configured to have wall structure, with the wall structure of the inner end of the second brace member sized to fit within the wall structure of the inner end of the first brace member, and for the wall structure of the second upper brace member to engage the wall structure of the first lower member to resist upward pivotal movement of the second brace member when the brace members are in the extended position.

12. The ironing board assembly of claim 11 wherein the wall structure inner end of the second upper brace member has at least three walls at general right angles to each other, and the first lower brace member wall structure has a generally channeled shape configuration with three walls at generally right angles to each other and sized to snuggly receive the walls of the second brace member inner end when the brace members are in the extended position.

* * * * *